United States Patent [19]

Cochran

[11] 4,018,274

[45] Apr. 19, 1977

[54] WELL PACKER

[75] Inventor: Chudleigh B. Cochran, Houston, Tex.

[73] Assignee: Brown Oil Tools, Inc., Houston, Tex.

[22] Filed: Sept. 10, 1975

[21] Appl. No.: 612,226

[52] U.S. Cl. ..... 166/129; 166/138; 166/182

[51] Int. Cl.[2] ..... E21B 33/12

[58] Field of Search ..... 166/129, 182, 183, 138, 166/139, 123

[56] References Cited

UNITED STATES PATENTS

| | | | |
|---|---|---|---|
| 3,279,542 | 10/1966 | Brown | 166/139 |
| 3,357,489 | 12/1967 | Brown | 166/139 |
| 3,420,306 | 1/1969 | Brown | 166/139 |
| 3,467,184 | 9/1969 | Young | 166/182 |

*Primary Examiner*—James A. Leppink
*Attorney, Agent, or Firm*—Carlos A. Torres

[57] ABSTRACT

Disclosed is a retrievable, weight set well packer which is set and released by longitudinal movement of the tubing string. Locking means are provided for keeping the packer set when the tubing is raised slightly to open a bypass between the tubing and set packer. Continued raising of the tubing releases the lock means to permit the packer to be retrieved. Dual opposed spreader cones keep the packer set against pressure induced forces in either direction. Differential sealing areas are also employed to prevent such forces from opening the bypass.

12 Claims, 6 Drawing Figures

WELL PACKER

BACKGROUND OF THE INVENTION

The invention relates to well packer devices of the type customarily used in the production of petroleum effluents from wells. The packer seals the annulus between the well casing and the production tubing string through which the well effluents flow to the surface. These packers are sometimes employed to provide seals for injecting fluids into the well and for a variety of other purposes.

The prior art packer design usually includes an annular resilient seal, a mechanical anchor or slips and a downwardly facing spreading cone. The packer is set by lowering the cone behind the slips which extends the slips into tight frictional engagement with the surrounding casing to anchor the packer in place. During this setting action, the packer seal is also compressed so that it expands radially into sealing engagement with the tubing and casing to seal the annulus. In conventional weight-set packers, the packer seal and slips are held in set, extended position by the tubing weight.

In many instances, as for example when weighted well fluids are to be displaced from the well to permit the well to flow, it is desirable to simultaneously flow fluids through both the tubing and the annulus after the packer has been placed at the desired subsurface location. One prior art weight set packer design provides a bypass through the packer for this purpose. The bypass is opened, after the packer is set, by raising the tubing string sufficiently to remove a tubing seal from its seat. With the bypass opened, the weighted fluids are displaced from the well by pumping lighter fluids down through the tubing. The lighter fluids exits the bottom of the tubing and, together with the displaced weighted fluid, flows to the well surface through the annulus and bypass.

The upward flow of the well fluids through the bypass of the described prior art packer exerts a lifting force on the set packer. Since the tubing weight is removed from the packer while the bypass is opened, the pressure induced force may be sufficient to cause the packer to release and move upwardly through the casing. The orientation of the single spreader cone is such that it wedges the slips to prevent only downward movement of the packer and is thus ineffective in preventing such upward packer movement.

When the top of the tubing is lowered into place in the well head, if the packer position has been raised, excessive tubing weight may be rested on the packer which in turn may damage both the packer and the tubing. This danger is controlled in part by maintaining a relatively slow pumping rate so that the packer remains at the proper location.

Under normal producing conditions, the pressure in the well annulus is greater below than above the packer seal. The resulting pressure differential creates upwardly directed forces which, in some instances, may unset the packer even with the proper tubing weight resting on the packer. To avoid this problem, the prior art packer previously described employs "hydraulic hold-down buttons" in the packer body. The pressure differential creates forces which extend the buttons into frictional engagement with the well casing to assist in holding the packer in place. Whie these hold-down buttons are effective in preventing pressure induced release of the set packer, they are objectionable to the extent that they require the use of resilient, slidable seal rings which are prone to leakage.

An alternative design for preventing pressure induced packer release requires the use of upper and lower opposed cone members which are moved toward each other to extend slips disposed between the cones. Movement of the set packer in either direction is prevented by the action of the two cones which increase the slip's gripping force in response to an increase in the forces tending to move the packer in either direction.

While dispensing with the need for hydraulic hold down buttons and their attendant leakage danger, the dual cone design when employed in mechanically set packers has conventionally required that the tubing string be rotated in order to release the packer from set position. Longitudinal movement of the tubing relative to the set packer is also not usually possible with such a design so that such movement cannot be employed to open a bypass through the packer. Rotation of the tubing for any reason may be undesirable in extremely deep or deviated well bores or where the well is being completed from a floating drilling rig. Certain hydraulically set packers employing dual cones can be released by non-rotative manipulation of the tubing string, however, hydraulically set packers are generally more expensive and have a longer length than mechanically set packers. Short packers are desirable in deep and highly deviated wells since they are easier to handle and reduce the danger of sticking.

The same pressure induced forces which tend to unseat the packer may also tend to open the bypass by pushing the tubing seal out of the set packer. The described prior art packer prevents such pressure induced movement of the tubing with a spring loaded sleeve having two sliding seals. The effective area across the sliding seals produces a net downwardly directed pressure induced force is produced on the sleeve. A collet assembly carried on the sleeve compresses the spring and transmits the induced force to the tubing so that the pressure induced forces tending to drive the tubing upwardly through the packer are always less than those tending to drive the tubing downwardly. The spring retains the sleeve and its attached collet in cocked position, ready to engage and lock the tubing, when the bypass is opened and no pressure differential exists across the sleeve's sliding seals.

SUMMARY OF THE INVENTION

The weight set packer of the present invention employs novel locking means for retaining the packer in set condition while the tubing is raised to open the bypass. The locking means may be released by continued non-rotational upward movement of the tubing to provide the benefits of "straight pull" retrieval. Dual opposed cones rather than hold-down buttons are employed to prevent pressure induced release of the packer. A novel pressure compensation means prevents the pressure differentials across the set packer from opening the bypass. The packer may be employed for a conventional production packer, a squeeze packer, an acidizing packer and for a variety of other purposes.

During the setting procedure, mating portions of the packer are telescoped together to extend the slips and packer seal. In the preferred embodiment of the invention, as underlying locking sleeve is moved to locking position as the packer is set. The locking sleeve cooperates with a locking slip to provide a ratchet like arrangement which holds the mated portions, including the upper downwardly facing cone, in telescoped position so long as the locking sleeve remains in locking position. The locking means allows limited lost motion between the tubing and the set packer to permit opening and closing of the bypass by longitudinal, non-rotative tubing movement. Raising the tubing beyond the lost motion limit moves the locking sleeve to release position which releases the locking slip permitting the telescoped packer components to return to their original positions. The packer may then be retrieved by a continued straight upward pull of the tubing string.

The pressure compensation means, in the preferred form of the invention, includes a piston with two different size sliding sealing areas configured to produce a net downwardly directed force on the piston during normal producing conditions. The piston exerts downwardly directed, pressure induced force through a split metal ring which bears against a shoulder on the central packer mandrel. As a result, the net downwardly directed pressure induced force acts on the tubing to prevent undesired opening of the bypass. The compensation means thus employs a simple split ring and piston arrangement to effect pressure compensation. An important feature of the piston and split ring arrangement, in addition to its simplicity and low cost, is that there are no physical means such as fingers or the like which connect the split ring to the piston. Thus, the operation of the compensation means is not dependent upon the position of the mandrel relative to the piston. One benefit deriving from this design difference is that the piston may change its position relative to the mandrel and move out of engagement with the split ring when the pressure acting across the set packer is greatest from above the packer without exerting any force whatsoever on the mandrel. This ensures that the bypass will not be opened under these pressure conditions.

By contrast, the prior art pressure compensation means designed to keep the bypass closed employs a locking means which is tied to the piston by fingers. As a result, frictional forces, corrosion, distortion, obstruction or other factors which would interfere with the upward movement of the locking means along the mandrel caused by a pressure reversal will exert a lifting force through the fingers to the mandrel and may also damage the locking means. Also, depending upon the type and size of bypass seal being used and the amount of lifting which occurs, the bypass may be partially opened when a pressure reversal occurs. Such opening defeats the purpose of the packer and the reverse fluid flow through the partially opened bypass may damage the bypass seal and render the packer inoperative.

Still another advantage in the design of the pressure compensating design of the present invention as compared to the prior art design is that there is no tendency to bind the piston when the tubing is raised to open the bypass. In the prior art design, the piston and locking means are tied together by fingers to form a single, inseparable unit so that any misalignment between the mandrel and piston may cause the piston to bind or distort, damaging the sliding seals.

It will accordingly be appreciated that a major object of the invention is to provide a bypass means in a mechanically set well packer wherein the bypass may be opened and closed, while the packer is locked in anchored condition, by manipulation of the tubing string.

Another object of the invention is to provide a well apparatus which can be both set and mechanically locked in set condition against pressure differentials in either direction, by non-rotative manipulation of the tubing string.

Still another object of the invention is to provide a packer in which the setting, bypass control and retrieval operations may all be effected by longitudinal, non-rotative manipulation of the tubing string and in which the packer remains locked in set position while the bypass is opened.

In a packer of the type herein described, it is also an object to provide mechanical means which function independently of hydraulic pressure to lock the packer in set position against a pressure differential acting in either direction.

A further object of the invention is to provide a locking means which retains the packer in set position while permitting limited longitudinal movement of the tubing string but which releases the packer from its set condition when the tubing is raised beyond a predetermined amount.

An object of the present invention is to provide a pressure compensation means having a pressure movable piston and a separate latching element for engaging the packer mandrel whereby the piston may move upwardly without raising the latching element and lifting the latching element does not bind or damage the piston.

These and other objects and features of the invention may be more fully appreciated from the following specification, claims and the related drawings.

DESCRIPTION OF THE ILLUSTRATED EMBODIMENT

Figure 1:
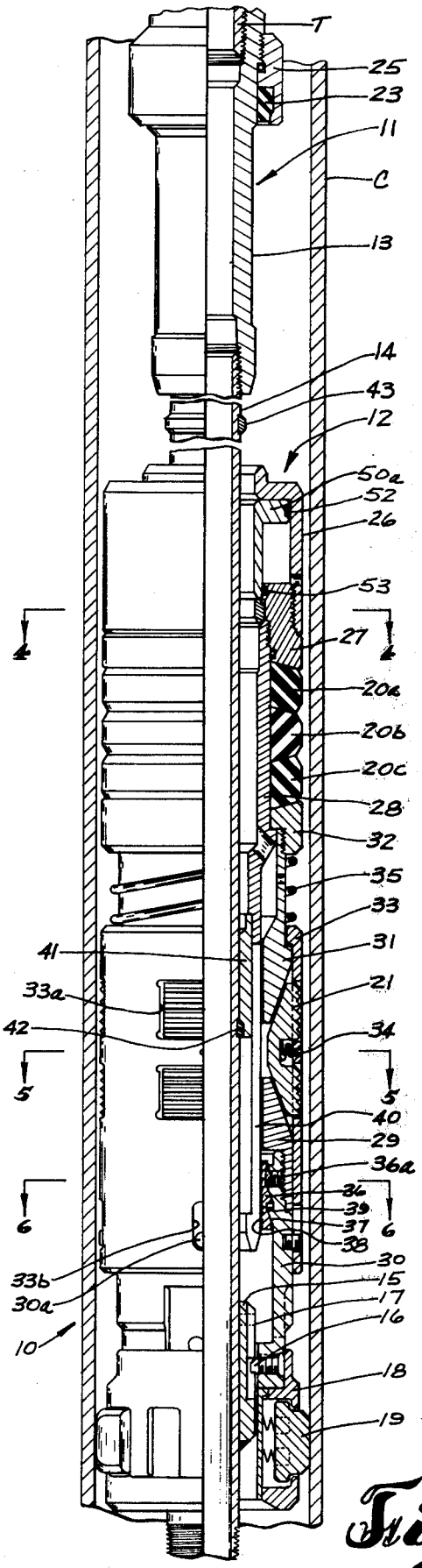
FIG. 1 is a view partially in vertical section and partially in elevation illustrating the packer of the present invention in unset condition as it would appear while being lowered into position within the well casing.

The well packer of the present invention, indicated generally at 10, is illustrated within a well casing C. The packer is suspended within the casing by a tubing string T which is threadedly engaged to the upper end of a mandrel assembly indicated generally at 11. The assembly 11 extends centrally through the packer body which is indicated generally at 12. The mandrel assembly 11 which provides a tubular conduit through the packer body includes an upper pup joint section 13 which is threadedly secured to a tubular mandrel body 14.

The packer body 12 is supported on the mandrel body 11 through the combined operation of a J-slot sleeve member 15 welded or otherwise suitably secured to the mandrel body 14 and a J-slot pin 16 carried at the lower end of the packer body. In a conventional manner, the pin 16 extends into one of a plurality of J-slots 17 (best illustrated in FIG. 2) formed in the sleeve 15. The slots include an upper and lower position stop 17*a* and 17*b* respectively, a vertical passage 17*c* and a diverging mouth 17*d*. A friction drag assembly 18 employs spring loaded friction blocks 19 to hold the packer body in frictional engagement with the internal wall of the casing C for a purpose to be described.

Figure 2:
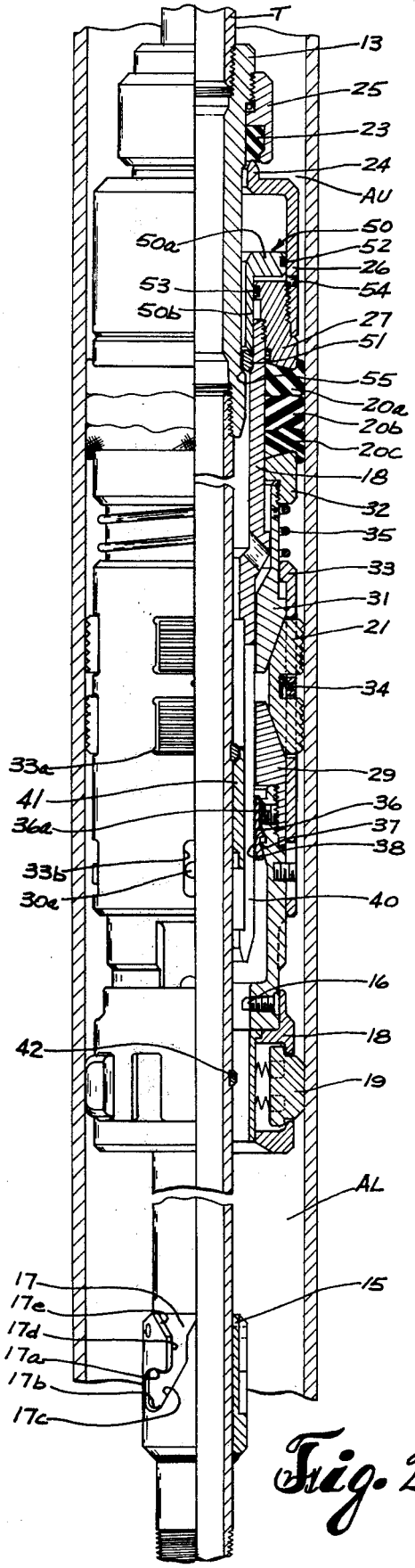
FIG. 2 is a view similar to FIG. 1 illustrating the packer in its set condition with the bypass closed.

The packer body 12 includes resilient packer seals 20*a*, 20*b*, and 20*c* and metal anchoring slip segments 21. The seals 20 function to form a fluid seal with the surrounding casing wall when the packer is set. The slip segments 21 are extended radially outwardly into firm gripping engagement with the surrounding casing wall when the packer is set to firmly anchor the packer body to the casing. FIG. 2 illustrates the packer in its set condition.

Figure 3:
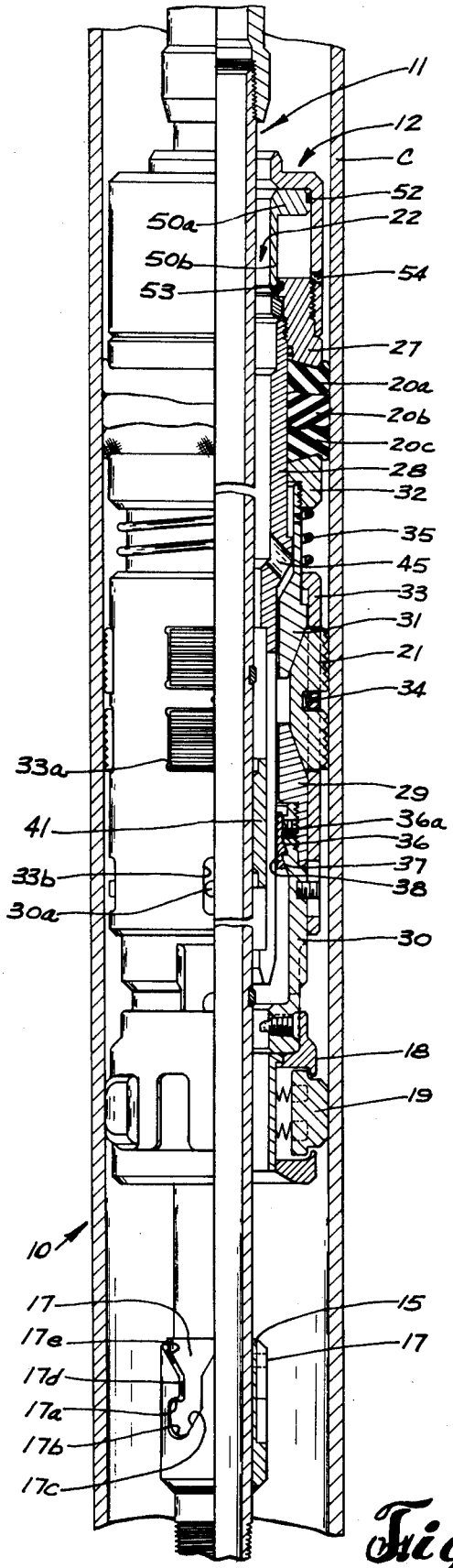
FIG. 3 is a view similar to FIGS. 1 and 2 illustrating the packer in set position with the bypass opened.
Figure 4:
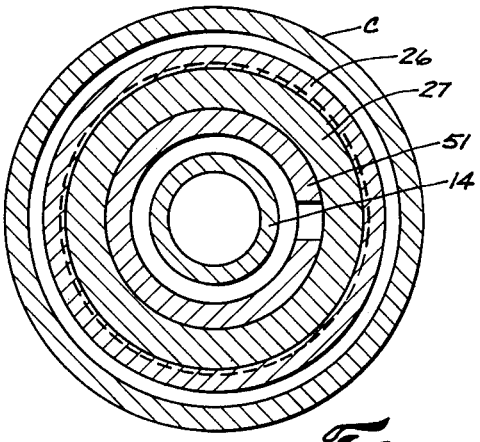
FIG. 4 is an enlarged scale horizontal cross sectional view taken along the line 4—4 of FIG. 1.
Figure 5:
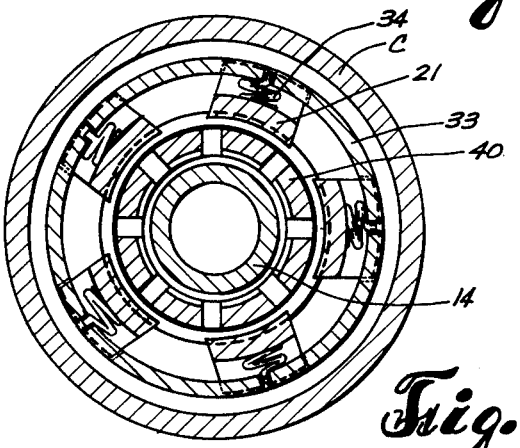
FIG. 5 is an enlarged scale horizontal sectional view taken along the line 5—5 of FIG. 1.
Figure 6:
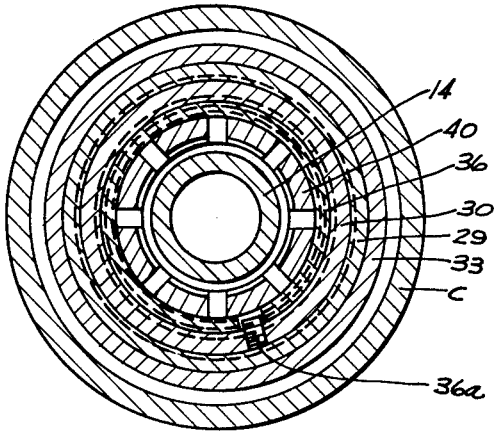
FIG. 6 is an enlarged scale horizontal cross sectional view taken along the line 6—6 of FIG. 1.

FIG. 3 illustrates the packer in set position but with the mandrel assembly 11 slightly elevated to open an annular bypass flow passage 22 which extends longitudinally between the packer assembly and the packer body. The flow passage is closed when the tubing string T and attached mandrel assembly 11 are lowered into the position illustrated in FIG. 2. In this latter position, an annular resilient face seal 23 carried by the mandrel assembly engages an upwardly extending annular seat 24 carried by the packer body 12. The seal 23 is held in position on the mandrel assembly 11 by a seal retainer 25 threadedly secured to the upper end of the pup joint 13.

The packer 10 is set by moving upper and lower component assemblies of the packer body toward each other to compress the seals 20 and extend the slip segments 21. The upper component includes a compensator housing 26, an upper seal retainer 27 and a seal mount assembly 28. These three members are threaded together in the illustrated manner so that they move as a unit.

The lower component includes a lower spreader cone 29, a connector sleeve 30 and the friction drag assembly 18. The lower spreader cone 29 and connector sleeve 30 are secured to each other by threads while the friction drag assembly is secured to the sleeve 30 by a conventional pin and slot connection which is released by partial rotation of the drag assembly relative to the connector sleeve. Release of this connection is prevented by a locking means (not illustrated) which is inserted between the two components to prevent such relative rotation.

The lower spreader cone 29 cooperates with an upper spreader cone 31 which in turn is connected to a lower seal retainer 32. The wedging portion of the spreader cone 31, the anchoring slip segments 21 and the lower spreading cone 29 are disposed within a tubular slip cage 33. The gripping forces of the slip segments extend through cage windows 33*a*. Springs 34 positioned between the slip cage and the slip segments bias the segments toward a radially retracted position out of engagement with the surrounding casing wall. During the setting operation, the upper and lower spreading cones are moved toward each other to wedge the slips outwardly, overcoming this biasing force and extending the slip segments into anchoring position. Pins 30*a* extend from the connector sleeve 30 into slots 33*b* in the slip cage to permit relative longitudinal displacement between the slip cage 33 and the lower spreader cone 29 as required during the packer setting.

A helical spring 35 disposed between the lower seal retainer 32 and the upper end of the slip cage 33 urges the retainer and cage components apart. During the setting procedure, the spring 35 ensures that the slip cage 33 and slip segments 21 are lowered over the bottom spreader cone 29 before the upper spreader cone 31 begins to act against the slip segments. As will be hereinafter more fully explained, this ensures that both the lower and upper cones are firmly against the slip segments when the packer is set.

An important feature of the present invention is its ability to remain locked in set position while the mandrel assembly 11 is raised sufficiently to open the bypass 22. This ability derives in part from the operation of locking slips 36 which lock the upper and lower components of the packer body together in the collapsed, telescoped position illustrated in FIGS. 2 and 3. As will be explained, the locking slips 36 permit the upper component to move downwardly through the lower component but prevents the reverse movement of the two components until the slips are disengaged by sufficiently raising the tubing string.

The locking slips 36 are constructed in the form of an annular split ring which has tapered helically developed outer surfaces 37 and internal, helically developed gripping teeth 38. The outer surfaces 37 bear against oppositely tapered surfaces 39 formed internally of the connector sleeve 30. The gripping teeth 38 engage and bite into the outer surface of collet fingers 40 which extend downwardly from the seal mount sleeve 28. A threaded pin 36*a* extends from the connector sleeve into the split in the ring forming the locking slips 36 to prevent relative rotation between the slips and the sleeve.

The collet fingers 40 are resilient and may be moved radially. When the packer is set, a locking sleeve 41 is moved under the collet fingers opposite the locking slips 36 to prevent the collet fingers from moving inwardly so that the gripping teeth 38 retain a firm bite on the mandrel surface. As will hereafter be more fully explained, longitudinal non-rotative lowering movement of the tubing string T and the attached mandrel assembly 11 moves the locking sleeve 41 under the collet fingers 40 and locking slips 36 during the setting procedure. Similar upward movement of the tubing removes the locking sleeve from such position, into the position illustrated in FIG. 1, when the packer is being released from the set position. For this purpose, a lower split ring 42 carried on the mandrel body 14 is adapted to engage the lower end of the locking sleeve 41 to pull the sleeve upwardly with upward movement of the mandrel during the retrieval operation. An upper split ring 43 carried on the mandrel body is adapted to engage the upper end of the sleeve 41 during the setting operation to lower the sleeve below the collet fingers 40 and locking slips 36.

When the bypass through the set packer is opened, fluids in the annulus may flow into or out of the bypass 22 through ports 45 which extend through the seal mount sleeve 28. When the tubing is lowered into the position illustrated in FIG. 2, the face seal 23 engages the annular seat 24 to close the bypass opening. Under normal producing conditions, the pressure existing in the closed bypass opening and in annulus area AL below the set seal is greater than the pressure existing in annulus area AU above the packer. Under these circumstances, a pressure differential exists across the face seal 23 which exerts an upward lifting force on the tubing string T and the attached mandrel assembly 11. To prevent this lifting force from opening the bypass, a two-piece compensating system is employed to exert a compensating downwardly directed force.

The compensating assembly includes a piston member indicated generally at 50 and a bearing ring member 51. An annular O-ring seal 52 is carried in a head portion 50*b* of the piston to provide a sliding seal with the internal surface of the compensator housing 26. A second O-ring seal 53 positioned in the upper seal retainer 27 forms a sliding seal with a depending body portion 50*b* of the piston 50. An opening 54 through the compensator housing 26 permits the pressure existing in the annular area AU to communicate with the seals 52 and 53. The piston member 50 exerts a downwardly directed force on the bearing ring 51 which in turn imparts the force to the mandrel assembly through a shoulder 55 formed on the pup joint 13.

PLACING AND SETTING THE PACKER

The packer 10 is lowered into the well casing with its parts in the relative positions illustrated in FIG. 1. In this configuration, the friction blocks 19 in the drag assembly 18 slide along the internal surface of the casing C, resisting the sliding motion. The frictional forces exerted by the drag assembly are overcome by the weight of the tubing string which is exerted against the pin 16 through the top position 17*a* of the J-slot 17.

When the desired subsurface location has been reached, the downward motion of the tubing string T is stopped and the tubing string is raised slightly until the pin 16 is engaged by the lower position 17*b* of the J-slot 17. During this raising movement, the packer body is held stationary within the casing by the action of the drag assembly 18. With the pin at the lower position 17*b*, the tubing string is slightly rotated causing the pin to ride up the inclined portion 17*c* of the J-slot so that subsequent lowering of the tubing string T causes the pin to move into the vertical passage section 17*d* of the slot. In this position, the tubing string may be further lowered to continue the setting operation.

Continued lowering of the tubing string T permits the lower end of the seal retainer 25 to engage the top surface of the compensator housing 26. Subsequent lowering of the tubing string exerts a downwardly directed force against the upper component portion of the packer body which causes the seal mount sleeve to telescope downwardly through the lower component which is held stationary by the friction drag assembly 18. This action causes the collet fingers 40 to move downwardly relative to the locking slips 36 and the attached connector sleeve 30. As the upper and lower component assemblies move toward each other, the cones 31 and 29 also advance toward each other causing the slip segments 21 to be wedged radially outwardly into gripping engagement with the surrounding casing. Once the slip segments grip the casing, very large downwardly directed forces may be exerted against the packer body without displacing the packer.

During the initial portions of the lowering movement, the spring 35 urges the slip cage 33 downwardly which in turn urges the slip segments 21 downwardly over the lower spreader cone 29. As a result, the lower spreader cone initially engages the slips causing the slips to move outwardly as they advance downwardly along the lower spreader cone. Once the slips have engaged the casing, subsequent lowering of the packer overcomes the biasing force of the spring 35 permitting the upper cone 31 to engage the anchoring slips. By this means, the spring 35 functions to ensure proper positioning of the lower spreader cone behind the slip segments 21 during the setting operation. In the absence of the spring 35, there is a possibility that the setting operation would cause the upper cone to first engage the slips 21 leaving a gap between the lower spreader cone and the slips which would permit the lower component of the packer body to move upwardly under the influence of the compressed packer seals 20*a*, 20*b* and 20*c* after the tubing weight was relieved. Such movement of the lower cone could prevent proper setting or placement of the packer.

As the packer is lowered during this setting operation, the upper split ring 43 engages the upper end of the locking sleeve 41 causing the sleeve to move downwardly from the position illustrated in FIG. 1 into the position illustrated in FIG. 2. In this latter position, the sleeve 41 holds the collet fingers 40 rigidly against the gripping teeth 38 of the locking slip 36. Because of this function, this sleeve 41, in the position shown in FIG. 2, acts as a blocking means to block unlocking movement of the collet fingers 40 relative to the locking slips 36. The upper and lower components of the packer body attempt to return from the position illustrated in FIG. 2 to the position illustrated in FIG. 1 when the tubing weight is removed from the packer body due to the resilient urging exerted by the compressed packer seals 20*a*, 20*b* and 20*c*. The engagement of the gripping teeth 38 with the collet fingers 40 causes the locking slip 36 to attempt to move upwardly with the upper component which in turn forces the tapered outer surface 37 of the slips against the tapered surfaces 39 on the connector sleeve 30. This produces a wedging action which causes the locking slips 36 to more firmly grip the collet fingers 40.

In the set position illustrated in FIG. 2, the well packer 10 is firmly anchored against well pressures acting against the packer in either direction. Thus, if the pressure in the lower annular area AL is greater than that in the upper area AU, a net upwardly directed force is exerted against the packer seals 20*a*, 20*b* and 20*c*. This force is imparted to the upper component which in turn acts through the locking slips 36 causing the lower spreader cone 29 to exert additional force against the slip segments 21 which in turn increases the anchoring force in the packer. This force increases as the pressure differential increases. If the pressure above the packer in the area AU is greatest, a net downwardly directed force is exerted on the packer seals. This force acts against the lower seal retainer 32 which is rigidly connected to the upper spreader cone 31 so that once again, the slips 21 exert an increasing anchoring force as the pressure induced forces acting on the packer increase.

The same pressure differentials which act across the packer seals also act across the bypass seal 23 when the bypass is closed. With a higher pressure below the face seal, the pressure differential tends to raise the mandrel assembly 11 to unseat the bypass seal. A compensating downwardly directed force created by the same pressure differential is produced by the compensating assembly to prevent undesired opening of the bypass seal.

Compensation is accomplished, in part, by dimensioning the seals 52 and 53 such that the effective sealing area provided by the piston 50 in greater than the effective sealing area of the bypass seal 23. The result is that the piston member 50 is forced downwardly by the effects of the pressure differential. This downwardly directed force causes the piston 50 to move downwardly from the position illustrated in FIG. 1 against the bearing ring 51.

The ring 51 is split and its lower surface is tapered and in engagement with a correspondingly tapered surface at the upper end of the seal mount sleeve 28. The downward force exerted by the piston on the ring 51 causes the two tapered surfaces to compress the ring so that it moves out of its upper position illustrated in FIG. 1 into the position illustrated in FIG. 2. In this latter position, the bearing ring engages the shoulder 51 to transmit the downwardly directed piston forces to the mandrel assembly.

If a reversal of the direction of the pressure differential occurs such that the pressure above the packer is higher than that below the packer, the piston 50 returns to its upper position leaving the bearing ring 51 in the position illustrated in FIG. 2. As a result, no upwardly directed forces are imposed on the mandrel assembly which might tend to unseat the face seal 23 or damage the seals cooperating with the piston 50.

A related benefit permitted in part by the ability of the packer to withstand reversal of pressure without damage is that the packer may be more securely anchored in set position by supplying hydraulic pressure from the well head to the annular area SU if insufficient tubing weight is available for securing the desired setting forces. This feature is important, for example, in shallow wells where only a small length of tubing extends between the well surface and the packer. Once the packer is set, the hydraulic pressure at the well head may be relieved with the locking means of the present invention functioning to hold the packer firmly set.

OPENING AND CLOSING THE BYPASS

The bypass 22 may be opened by lifting the tubing string T to remove the face seal 23 from the seat 24. While only a very little amount of upward tubing movement opens the bypass, the tubing may be elevated without disturbing the set condition of the packer to the point that the lower split ring 42 first engages the lower end of the locking sleeve 41. In a practical application, the amount of this "stroke" would be approximately thirty inches, but could be more or less depending upon the use to which the packer is to be put.

Since the upper and lower components of the packer body are tied together through the locking slip 30, independently of the packer mandrel assembly 11, the packer remains in set condition while the mandrel is elevated for opening the bypass. As a result, well fluids may be circulated downwardly through the tubing string through the annulus and flow passage 22 at a rapid rate without concern for either unsetting or moving the packer.

Since the packer body remains set independently of the presence or absence of tubing weight on the body, only enough tubing weight need be set on the packer so that the face seal 23 and seat 24 contact sufficiently to ensure closure of the bypass 22. This permits a very large portion of the tubing weight to be carried by the well head so that the tubing string can be stretched out to assume as linear a configuration as possible. This in turn facilitates wireline operations and similar servicing which must be performed through the tubing string. Moreover, additional latitude in the designing and construction of the packer is permitted since the packer need not withstand the usual tubing weight load required in maintaining a weight set packer anchored, during production.

RELEASING AND RETRIEVING THE PACKER

The packer 10 is released from its set position and retrieved to the surface or repositioned for subsequent resetting by raising the tubing string T. This draws the lower split ring 42 against the locking sleeve 41 and slides the locking sleeve upwardly within the collet fingers 40 to the position illustrated in FIG. 1. With the sleeve 41 thus positioned, the collet fingers 40 are free to bend radially inwardly permitting them to release from the gripping teeth 38 of the locking slip 36. The lifting force of the mandrel assembly is transmitted through the split ring 42 and locking sleeve 41 to the seal mount sleeve 28 which in turn transmits the force to the upper spreader cone 31 drawing the cone off of the slip segment 21. Continued upward lifting causes the cone 31 to raise the slip cage 33 which in turn pushes the anchoring slips 21 off of the lower spreader cone 29. This action permits the upper and lower components of the packer body to return to their original, uncollapsed position permitting the packer seals **20*a*, 20*b*, and 20*c* and the anchoring slip segments 21** to be returned to their retracted positions.

Following retraction of the packer slips and seals, subsequent upward movement of the tubing string draws the J-slot sleeve member 15 into engagement with the pin 16 and the pin enters the tapered mouth section **17*e* of one of the multiple J-slots in the sleeve. As the tubing is further raised, the lower stop portion 17*b* of the slot is drawn into engagement with the pin. Subsequent raising lifts the drag assembly 18 and the attached packer body 12** upwardly with the tubing.

The packer may be moved to a lower position by merely lowering the tubing string causing the pin 16 to move to the upper slot position **17*a* so that the packer is in the configuration illustrated in FIG. 1.** The previously described setting procedure may then be repeated to anchor the packer at any location in the well without need for retrieving the packer to the well surface.

From the foregoing description, it will be appreciated that: a) the packer 10 may be both set and released by longitudinal, non-rotative movement of the tubing string or other member from which it is suspended; b) a bypass in the packer may also be opened and closed by such longitudinal movement while the packer remains firmly anchored in set condition; c) mechanical anchoring means automatically function to retain the packer firmly set against a high-pressure acting on the packer from either above or below; and d) pressure compensation means prevent the bypass from opening in response to pressure differentials while also preventing such differentials from acting through the compensation means to exert a lifting force on the tubing string when the pressure is highest above the packer.

The packer of the present invention has been described in its preferred embodiment, but various changes in the construction and operation of the packer may be made witout departing from the spirit of the invention. Thus, by way of example rather than limitation, by appropriate reversal of parts, the packer may be set by exerting tension on the tubing string.

I claim:

1. A well packer apparatus adapted to be carried by a tubing string in a well conduit comprising:

a. sealing means extendable between sealing and non-sealing engagement with the well conduit for selectively preventing or permitting fluid flow through said well conduit;

b. anchoring means extendable between anchoring and non-anchoring engagement with said well conduit for selectively anchoring said packer to the conduit or releasing said packer for movement relative to the conduit;

c. primary flow passage means extending through said packer for conducting fluids through said sealing means;

d. secondary flow passage means extending through said packer selectively operable for bypassing fluids through said packer when said sealing means is in sealing engagement with the well conduit;

e. setting means operable by movement of said tubing string in one direction for setting said packer by moving said sealing means into sealing engagement with said well conduit and moving said anchoring means into anchoring engagement with said well conduit;

f. locking means for locking said packer in set condition;

g. blocking means movable between blocking and non-blocking positions for blocking and not blocking, respectively, movement of said locking means toward unlocked position; and h. means operable by movement of said tubing string in the opposite of said one direction for moving said blocking means to non-blocking position.

2. A well packer apparatus as defined in claim 1 wherein said means operable by movement of the tubing string includes means permitting limited movement of said tubing string while said packer is in set condition without moving said blocking means to non-blocking position.

3. A well packer apparatus as defined in claim 1 wherein said packer includes release means operable by movement of said tubing string beyond the point of movement of said blocking means to non-blocking position, for unsetting said packer to permit said sealing means and said anchoring means to retract from engagement with the well conduit.

4. A well packer apparatus as defined in claim 2 wherein said packer includes bypass control means for opening and closing said secondary flow passage means by said permitted limited movement of said tubing string while said packer is in set condition and said blocking means is in blocking position.

5. A well packer apparatus as defined in claim 4 further including differential pressure actuated pressure compensating means for preventing pressure induced longitudinal movement of said tubing string which would open said secondary flow passage means.

6. A well packer apparatus as defined in claim 4 wherein said packer includes release means operable by movement of said tubing string beyond the point of movement of said blocking means to non-blocking position, for unsetting said packer to permit said sealing means and said anchoring means to retract from engagement with the well conduit.

7. A well packer apparatus as defined in claim 6 further including spreader means responsive to longitudinally directed forces exerted on said packer in either longitudinal direction for increasing the gripping forces exerted by said anchoring means as said longitudinally directed forces increase.

8. A well packer apparatus as defined in claim 3 wherein said packer includes bypass control means for opening and closing said secondary flow passage means by limited movement of said tubing string while said packer is in set condition.

9. A well packer apparatus for use in a surrounding well conduit comprising;

a. a mandrel connectible to a tubing string;

b. a packer body carried on said mandrel;

c. packer sealing means and anchoring means included in said packer body;

d. an upper component and a lower component including in said packer body;

e. setting means operable by longitudinal movement of said tubing string for moving said upper component and said lower component toward each other for setting said packer by extending said packer sealing means and said anchoring means respectively into sealing and gripping engagement with the well conduit;

f. a primary flow passage extending through said packer body;

g. locking means for locking said packer in set condition independently of forces exerted by said tubing string;

h. bypass flow passage means, in addition to said primary flow passage, extending through said packer for permitting flow past said well packer while said packer sealing means is extended into sealing engagement with the well conduit; and i. bypass control means comprising an annular seat and a face seal movable into and out of engagement with said seat for opening and closing said bypass flow passage means while said packer is locked in set condition.

10. A well packer apparatus as defined in claim 9 wherein said bypass control means includes means operable by longitudinal, non-rotative movement of said tubing string for opening and closing said bypass flow passage.

11. A well packer apparatus as defined in claim 10 further including release means operable by longitudinal, non-rotative motion of said tubing string beyond the point of separating said annular seat and face seal to open said bypass flow passage means, for unsetting said packer to permit said sealing means and said anchoring means to retract from engagement with the well conduit.

12. A well packer apparatus as defined in claim 11 further including differential pressure actuated pressure compensating means for preventing pressure induced longitudinal movement of said tubing string which would open said bypass flow passage means.

* * * * *

UNITED STATES PATENT AND TRADEMARK OFFICE

CERTIFICATE OF CORRECTION

PATENT NO. : 4018274

DATED : April 19, 1977

INVENTOR(S) : Chudleigh B. Cochran

It is certified that error appears in the above-identified patent and that said Letters Patent are hereby corrected as shown below:

In Column 1, line 66, delete "Whie" and insert therefore --While--.

In Column 2, line 67, delete "as" and insert therefore --an--.

In Column 8, line 19, insert --non-blocking-- after "the" and before "position".

In Column 8, line 20, insert --blocking-- before "position illustrated".

In Column 8, line 68, delete "in" and insert therefore --is--.

In Column 9, line 29, delete "SU" and insert therefore --AU--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*